US008172358B2

(12) United States Patent
Inoue

(10) Patent No.: US 8,172,358 B2
(45) Date of Patent: May 8, 2012

(54) DROPLET EJECTION HEAD CONTROL DEVICE AND CONTROL METHOD, AND PROGRAM STORAGE MEDIUM

(75) Inventor: Hiroshi Inoue, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 533 days.

(21) Appl. No.: 12/397,963

(22) Filed: Mar. 4, 2009

(65) Prior Publication Data

US 2009/0237435 A1 Sep. 24, 2009

(30) Foreign Application Priority Data

Mar. 18, 2008 (JP) ..... 2008-069284

(51) Int. Cl.
*B41J 2/165* (2006.01)

(52) U.S. Cl. ..... 347/22; 347/33; 347/14

(58) Field of Classification Search ..... 347/15, 347/11, 33, 14
See application file for complete search history.

(56) References Cited

U.S. PATENT DOCUMENTS

2004/0056915 A1* 3/2004 Miyazawa ..... 347/19
2005/0219285 A1* 10/2005 Inoue ..... 347/9
2006/0214958 A1* 9/2006 Inoue ..... 347/5
2007/0058009 A1* 3/2007 Furukawa et al. ..... 347/85
2008/0049066 A1* 2/2008 Inoue ..... 347/33

FOREIGN PATENT DOCUMENTS

JP 2006-88067 A 4/2006

* cited by examiner

*Primary Examiner* — Laura Martin
(74) *Attorney, Agent, or Firm* — Birch, Stewart, Kolasch & Birch, LLP

(57) ABSTRACT

A droplet ejection head control device includes a pressure alteration section, a detector and a controller. The droplet ejection head is provided with plural nozzles and is supplied with a liquid. The pressure alteration section alters a pressure inside the droplet ejection head. The detector detects a position of a boundary of liquid which is exuded onto a nozzle face from at least one nozzle of the droplet ejection head in accordance with the pressurization at the inside of the droplet ejection head. After the pressurization of the interior of the droplet ejection head commences, the controller controls the pressure alteration section on the basis of detection results from the detector such that the pressurization is stopped just (immediately) before respective boundaries of the liquid exuded onto the nozzle face from neighboring nozzles come into contact.

15 Claims, 4 Drawing Sheets

DROPLET EJECTION HEAD CONTROL DEVICE AND CONTROL METHOD, AND PROGRAM STORAGE MEDIUM

CROSS-REFERENCE TO RELATED APPLICATION

This application claims priority under 35 USC 119 from Japanese Patent Application No. 2008-069284, the disclosure of which is incorporated by reference herein.

BACKGROUND OF THE INVENTION

1. Field of the Invention

The present invention relates to a control device of a droplet ejection head, a control method and a program storage medium, and particularly relates to a control device, control method and program storage medium of a droplet ejection head at which a nozzle face is wiped for cleaning.

2. Description of the Related Art

A droplet ejection device (for example, an inkjet printer) that ejects liquid droplets such as ink from nozzles of a droplet ejection head (hereinafter referred to as a head) and forms an image, a pattern or the like at a recording medium has been known heretofore. In such a droplet ejection device, a maintenance unit is provided in order to excellently preserve ink ejection conditions of the head. The maintenance unit is provided with a wiper blade, which is a rubber plate or the like that wipes and removes foreign matter and the like adhering to a nozzle face, and a suction pump, which is connected via a cap for sucking and removing air bubbles in the nozzles, or the like.

When a nozzle face, in which ejection apertures of nozzles 80*a* of a head 80 are arrayed, is to be wiped for cleaning by a cleaning member such as a wiper blade, usually, ink is caused to exude to the exterior of the nozzle face, as shown in FIG. 7A. Adherents such as hardened ink, dirt, paper dust are immersed in the ink and dissolved or loosened from the nozzle face, and are then wiped off by the cleaning member. The exuded ink also acts as a lubricant between the nozzle face and the cleaning member and prevents damage to the surface of the head 80 during wiping by the wiper blade.

As a device with such a maintenance function, an inkjet application device is known (see Japanese Patent Application Laid-Open (JP-A) No. 2006-88067) that: applies a certain pressure within an ink tank, which is connected to an ink application head via ink supply piping; causes ink to exude to the exterior of a nozzle face provided at a distal end of the ink application head; causes the ink to project from the nozzle face within a range such that the ink does not drip in accordance with surface tension of the ink; and removes an ink surface that is formed at the exterior of the nozzle face.

However, even within the range in which ink does not drip because of surface tension, as shown in FIG. 7B, when the ink exuded from one nozzle 80*a* comes into contact with the ink exuded by neighboring nozzles 80*a*, the ink aggregates together and the exuded ink moves. As described above, adherents such as hardened ink, dirt, paper dust and the like are dissolved or loosened from the nozzle face by being immersed in the ink. However, if the exuded ink moves from nozzle peripheries, adherents near to the nozzles 80*a*, which will affect ejection, may not be immersed in the ink. As a result, the adherents may not be thoroughly removed. Moreover, when the ink aggregates together, the ink may drip due to its own weight. If this happens, in addition to thorough cleaning not being possible, a device interior may be soiled.

Furthermore, the surface tension of an ink varies with factors such as aging deterioration, ambient temperature. Therefore, even if ink is exuded under conditions such that the ink does not drip as in the above-mentioned technology described in JP-A No. 2006-88067, if the surface tension has changed because of aging deterioration of the ink, an ambient temperature or the like, the ink may drip and soil a device interior, and if an amount of exuded ink is insufficient, the surface of the head 80 may be damaged.

SUMMARY OF THE INVENTION

The present invention is made in consideration of the circumstances described above, and provides a control device of a droplet ejection head, a control method and a program storage medium that are capable of causing liquid to exude broadly onto a nozzle face without the liquid exuded from a nozzle coming into contact with and aggregating with the liquid exuded from a neighboring nozzle, regardless of changes due to aging deterioration of the liquid, ambient temperature or the like, and that improve cleaning characteristics.

One aspect of the present invention is a droplet ejection head control device including: a pressure alteration section that alters the pressure of an interior of a droplet ejection head, the droplet ejection head being provided with a plurality of nozzles and supplied with a liquid; a detector that detects a position of a boundary of liquid which is exuded onto a nozzle face from at least one nozzle of the droplet ejection head in accordance with pressurization at the interior of the droplet ejection head; and a controller that, after commencement of the pressurization at the interior of the droplet ejection head, controls the pressure alteration section on the basis of detection results of the detector such that the pressurization is stopped before respective boundaries of the liquid exuded onto the nozzle face from neighboring nozzles come into contact with each other.

Another aspect of the present invention is a method of controlling a droplet ejection head, the method including: pressurizing an interior of the droplet ejection head using a pressure alteration section, the droplet ejection head being provided with a plurality of nozzles and supplied with a liquid; after commencement of the pressurization at the interior of the droplet ejection head, detecting a position of a boundary of liquid which is exuded onto a nozzle face from at least one nozzle of the droplet ejection head in accordance with the pressurization; and controlling the pressure alteration section on the basis of detection results such that the pressurization is stopped before respective boundaries of the liquid exuded onto the nozzle face from neighboring nozzles come into contact with each other.

Still another aspect of the present invention is a computer readable storage medium storing a program causing a computer to execute a process for controlling a droplet ejection head, the process including: pressurizing an interior of the droplet ejection head using a pressure alteration section, the droplet ejection head being provided with a plurality of nozzles and supplied with a liquid; after commencement of the pressurization at the interior of the droplet ejection head, detecting a position of a boundary of liquid which is exuded onto a nozzle face from at least one nozzle of the droplet ejection head in accordance with the pressurization; and controlling the pressure alteration section on the basis of detection results such that the pressurization is stopped before respective boundaries of the liquid exuded onto the nozzle face from neighboring nozzles come into contact with each other.

BRIEF DESCRIPTION OF THE DRAWINGS

Exemplary embodiments of the present invention will be described in detail based on the following figures, wherein.

DETAILED DESCRIPTION OF THE INVENTION

Herebelow, examples of embodiments of the present invention will be described in detail with reference to the drawings.

First Exemplary Embodiment

Figure 1:
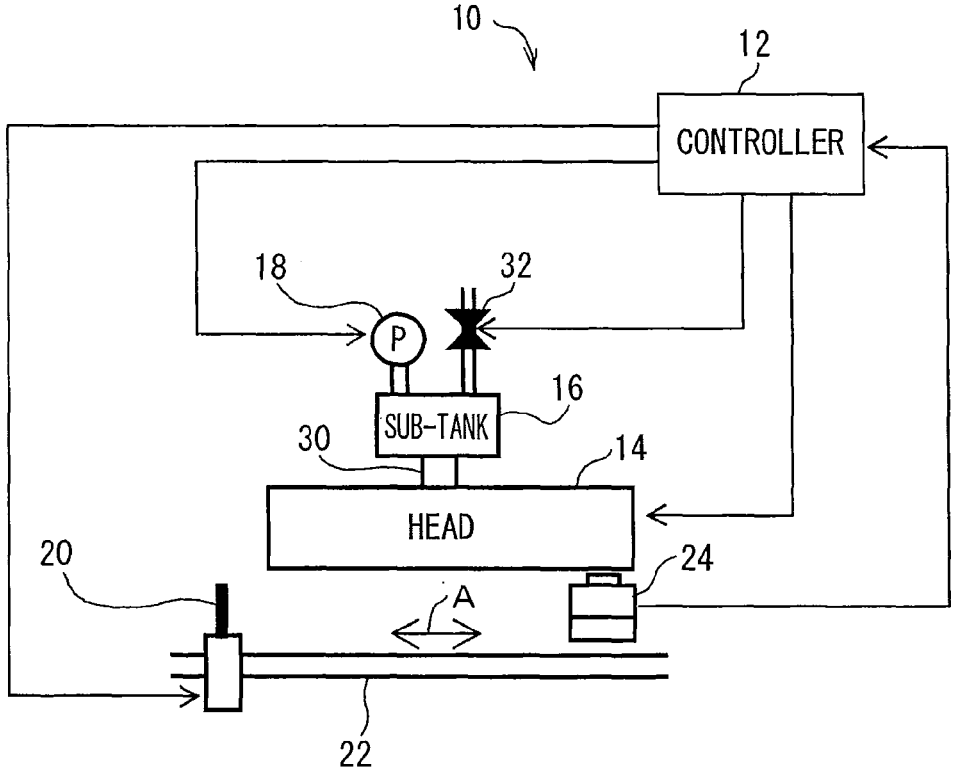
FIG. 1 is an example of a structural diagram of a droplet ejection device relating to a first exemplary embodiment.

FIG. 1 is an example of a structural diagram of a droplet ejection device 10 (an example of a droplet ejection head control device) relating to the exemplary embodiment.

As shown in FIG. 1, the droplet ejection device 10 is provided with a controller 12, a droplet ejection head (hereafter simply head) 14, a sub-tank 16, a pump 18, a wiping member 20, a support member 22 and an image capture device 24. In the exemplary embodiment, the droplet ejection device 10 is described as being a device that ejects ink at a recording medium or the like, but a liquid that is ejected is not to be limited to ink.

The controller 12 is constituted by a computer equipped with a CPU, RAM, ROM, an input/output port and the like. The CPU, RAM, ROM and input/output port are connected to one another through a system bus or the like. The RAM stores various control programs, information or data required for performing various kinds of controls (for example, data representing later-described timer measurement durations T1 and T2, thresholds TH1, TH2, and so forth). The CPU executes the programs stored in the ROM. The stored programs include a program of a processing routine for controlling pressure at the sub-tank 16 when in a maintenance mode, which is described later. The input/output port of the controller 12 is connected to the head 14, the wiping member 20, the pump 18, the image capture device 24 and the like. The controller 12 outputs control signals to motors or the like provided at the pump 18, the wiping member 20, and implements revolution control of the pump 18 and movement control of the wiping member 20. The controller 12 acquires image data of a captured image from the image capture device 24.

Figure 2A:
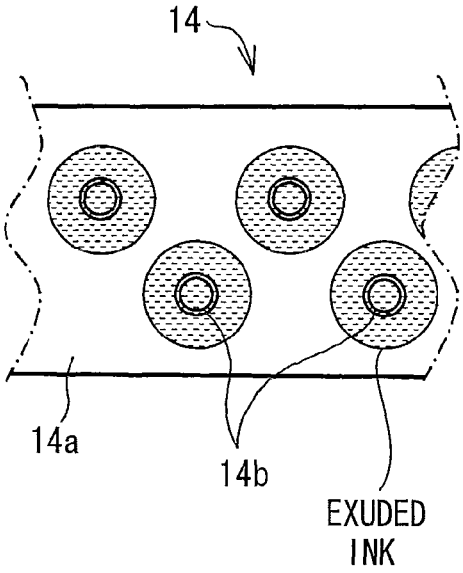
FIG. 2A is a view showing a state in which ink exudes from nozzles arranged at a nozzle face.

The head 14 features plural nozzles 14*b* which eject ink. Ejection apertures of the nozzles 14*b* are arrayed in a nozzle face 14*a* of the head 14 (see FIG. 2A).

The head 14 is further provided with plural pressure chambers, which are provided in correspondence with the plural nozzles 14*b* and are in communication with the nozzles 14*b*, and common channels, which are in communication with the plural pressure chambers. Herein, the pressure chambers and the common channels are omitted from the drawings. The common channels are in communication via supply piping 30 with the sub-tank 16, into which ink is charged. Ink supplied from the sub-tank 16 is distributed to the pressure chambers via the common channels. Unillustrated actuators are provided at the pressure chambers. Volumes of the pressure chambers are altered by driving of the actuators in accordance with image data, and ink drops are ejected from the ejection apertures of the nozzles 14*b*.

Ink is supplied from an unillustrated main tank to the sub-tank 16. The pump 18, which is capable of driving forward and in reverse, is connected to the sub-tank 16. An internal pressure of the head 14 (a pressure of the common channels and pressure chambers) may be adjusted by controlling internal pressure of the sub-tank 16 with the pump 18. An atmosphere-opening valve 32 is provided at the sub-tank 16. The interior of the sub-tank 16 may be opened to the atmosphere by opening this atmosphere-opening valve 32.

The wiping member 20 is formed of, for example, a rubber blade or an absorbent body, and is supported at the support member 22 to be movable in the direction of arrow A in FIG. 1. When the droplet ejection device 10 is in the maintenance mode, the wiping member 20 wipes the nozzle face 14*a* by sliding in the direction of arrow A, and removes ink exuded from the nozzles 14*b* along with loosened/dissolved adherents and the like.

Figure 2B:
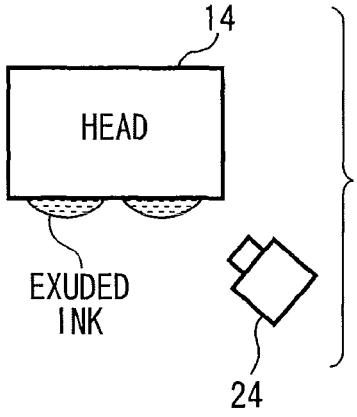
FIG. 2B is a view showing a state in which a region in which ink is exuded from the nozzle face is captured by an image capture device.

The image capture device 24 is a device for detecting positions of boundaries of ink that is exuded onto the nozzle face 14*a* from the nozzles 14*b*. As shown in FIG. 2B, the image capture device 24 is disposed at a position to be capable of capturing the nozzle face 14*a*. In the exemplary embodiment, the ink boundary positions may be outer peripheral positions of contacting areas between the exuded ink and the nozzle face 14*a* or outlines of the ink that has spread over the nozzle face 14*a*. An imaging device structuring the image capture device 24 may be a CCD, a CMOS or the like, and a light source, a lens and the like are provided as necessary. Image data captured by the image capture device 24 is inputted to the controller 12. The controller 12 monitors spreading states of the ink exuded from the nozzles 14*b* on the basis of the inputted image data, and implements pressure control of the pump 18.

In the exemplary embodiment, the image capture device 24 is fixedly disposed so as to be capable of capturing a region of a size such that boundary positions of ink exuded from a single nozzle 14*b* of the plural nozzles 14*b* can be recognized. In the exemplary embodiment, by capturing this region for a single nozzle 14*b* representing all of the nozzles 14*b*, a shortening of detection times and a reduction in costs are enabled. This is because, given that channel resistances of the nozzles 14*b* of the head 14 are substantially equal and liquid-repellence finishing is applied to the nozzle face 14*a* uniformly, variations in exuding spread amounts between the respective nozzles 14*b* will be small.

Figure 3:
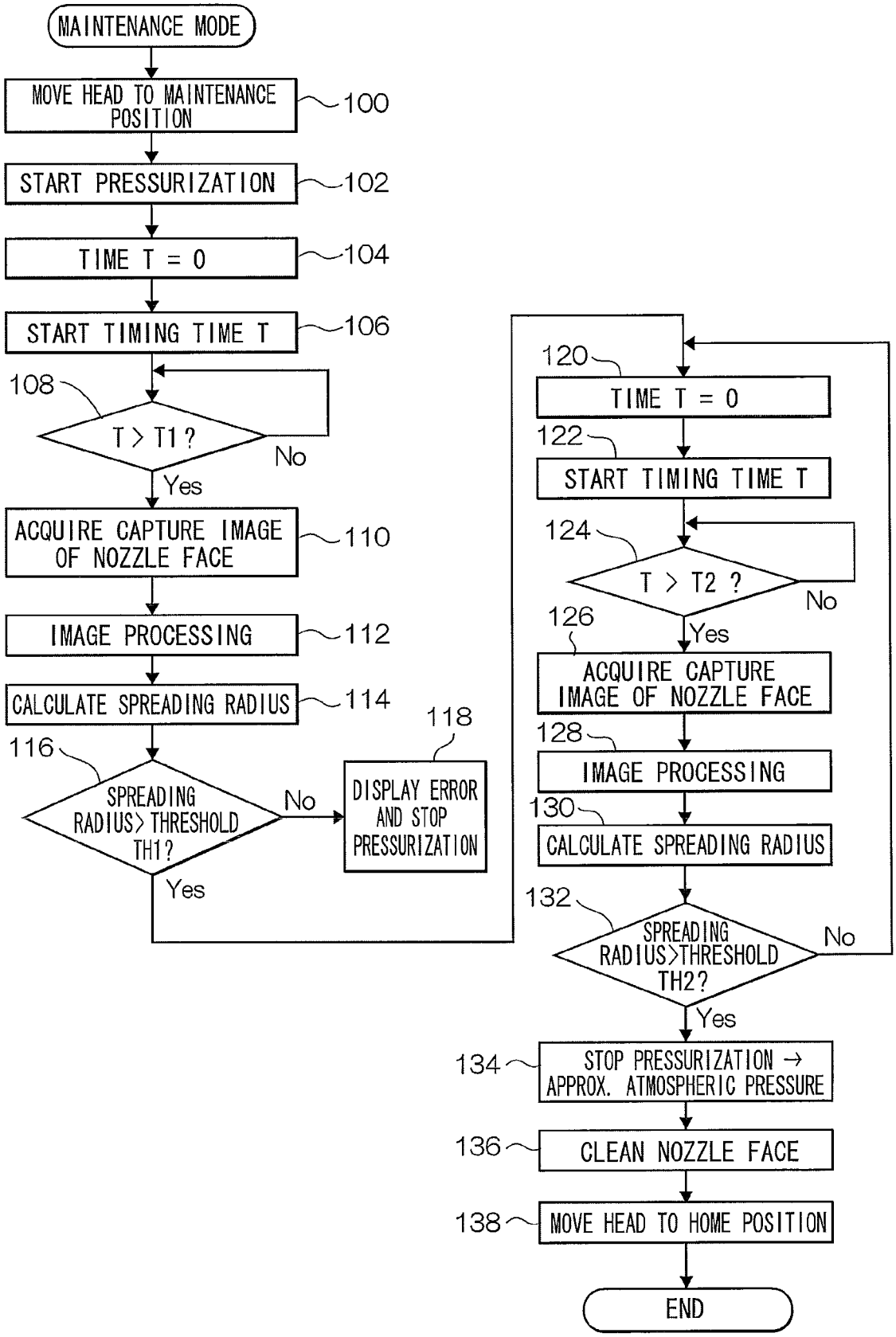
FIG. 3 is a flowchart showing the flow of a processing routine that is carried out by a control device when in a maintenance mode.

Next, operation of the droplet ejection device 10 when in the maintenance mode of the exemplary embodiment will be described. FIG. 3 is a flowchart showing the flow of a processing routine that is carried out by the controller 12 during the maintenance mode. Here, the actuators provided at the respective nozzles 14*b* are not driven in the maintenance mode.

When the maintenance mode begins, in step 100, the controller 12 moves the head 14 to a predetermined maintenance position. Thereafter, in step 102, the controller 12 controls the pump 18 and commences pressurization of the sub-tank 16. The interior of the head 14 is pressurized, and ink is caused to exude onto the nozzle face 14*a* from the nozzles 14*b*. Pressures at which exuding of the ink from the nozzles 14*b* begins vary in accordance with diameters, wetting characteristics and the like of the nozzles 14*b*. However, these variations can be eliminated by applying, in pulses, a sufficiently large pressure at a level that will not cause droplets to be ejected.

Then, in step 104, the controller 12 resets a timer T to zero, and in step 106 timing is commenced. In step 108, the controller 12 waits until the timer T passes a pre-specified duration T1. When the timer T passes the duration T1 in step 108, then in step 110, the controller 12 controls the image capture device 24 so as to capture the nozzle face 14*a*, and acquires the captured image data obtained by the image capture device 24. The acquired image data is saved in an unillustrated storage section (the aforementioned RAM or the like). Image data that has been obtained by imaging before ink exudes from the nozzles 14*b* (reference image data) has been stored in the ROM in advance.

In step 112, the controller 12 reads from the ROM the reference image data for before ink exudes, and performs image processing such as taking differences between the reference image data that is read and the image data that has been newly captured and acquired. Then, in step 114, boundary positions of the exuded ink are extracted by the image processing, and a spreading radius of exuded ink is calculated from the extracted boundary positions. Here, a distance from a central position of the ejection aperture of the target nozzle 14*b* to the boundary positions is calculated as the spreading radius of the ink.

Next, in step 116, the controller 12 compares the calculated spreading radius with the threshold TH1. If the calculated spreading radius is not larger than the threshold TH1, then in step 118, an error indication is displayed at an unillustrated display section (or an error sound is emitted by a sound source), and the pressurization is stopped. If the spreading radius of the ink pressurized up to the predetermined duration T1 is at or below the threshold TH1, it is assumed that ink has not been charged into the channels of the nozzles 14*b* or that a problem such as a malfunction of the pump 18 has occurred. Therefore, by pre-checking the spreading radius of the ink in step 116, such a problem can be discovered early and can be notified to the user. Thus, convenience for users is improved. Accordingly, the threshold TH1 may be set to a value slightly larger than the radius of the ejection aperture of the nozzle 14*b*.

If there is no problem in the pre-check of step 116 (i.e., if the calculated spread radius is larger than the threshold TH1), then from step 120, the controller 12 carries on and continues pressurization with the pump 18. At this time, because ink continues to be supplied from the sub-tank 16 to the nozzles 14*b*, the ink exuded around the nozzles 14*b* continues to spread on the nozzle face 14*a*, but does not drip because of surface tension.

At intervals of a duration T2, the controller 12 causes the image capture device 24 to carry out capturing of the nozzle face 14*a*, acquires image data from the image capture device 24, and calculates the spreading radius of the ink in the same manner as for the above described pre-check.

Specifically, in step 120, the controller 12 resets the timer T to zero, and starts timing in step 122. In step 124, the controller 12 waits until the timer T has passed the preset duration T2. When the timer T has passed the duration T2 in step 124, in step 126, the controller 12 controls the image capture device 24 so as to capture the head 14, and acquires the captured image data obtained by the image capture device 24. Then, in steps 128 and 130, image processing is carried out and an ink spreading radius is calculated in the same manner as in steps 112 and 114.

In step 132, the controller 12 compares the calculated spreading radius with the threshold TH2. If the calculated spreading radius is smaller than the threshold TH2, the controller 12 returns to step 120, continues to carry on pressurization, and performs the capturing when the duration T2 has passed again. The controller 12 repeats this processing until the spreading radius exceeds the predetermined value TH2.

When it is determined in step 132 that the calculated spreading radius is larger than the threshold TH2, then in step 134, the controller 12 controls the pump 18 so as to stop pressurization of the sub-tank 16, and sets the interior of the head 14 to approximately atmospheric pressure. Thus, the spreading of the ink stops, and a shape thereof is maintained.

Here, the threshold TH2 is set to a value slightly smaller than half a minimum distance between neighboring nozzles 14*b*. It is preferable for the threshold TH2 to be set to at least a quarter of the minimum distance and not be set to a value that is excessively small. Accordingly, the pressurization will be stopped in a state in which the boundary of the ink exuded from a nozzle 14*b* and the boundary of the ink exuded from another, neighboring nozzle 14*b* are separated by a small distance. That is, the pressurization may be stopped just (immediately) before the ink exuded from the nozzle 14*b* and the ink exuded from the neighboring nozzle 14*b* come into contact. Consequently, ink exuded from neighboring nozzles 14*b* does not come into contact and aggregate, dripping can be prevented, and the ink may be spread sufficiently widely on the nozzle face 14*a*.

Here, methods of setting the interior of the head 14 to atmospheric pressure are turning the pump 18 in reverse or providing an atmosphere-opening valve at the sub-tank 16 and opening the same to the atmosphere. In the exemplary embodiment, the atmosphere-opening valve 32 is provided as shown in FIG. 1 and the controller 12 controls the atmosphere-opening valve 32 to open up to the atmosphere. Because the atmosphere-opening valve 32 is employed and opened to the atmosphere, the interior of the head 14 can be set to atmospheric pressure more promptly than in a case of driving the pump 18 in reverse. As a result, control of spreading of the exuded ink is improved. Moreover, because atmospheric opening without applying a negative pressure with the pump 18 is possible, cases of exuded ink in which foreign matter adhered to the head 14 has been loosened or dissolved flowing back into the nozzles 14*b* are avoided.

Then, in step 136, the controller 12 moves the wiping member 20 and wipes the nozzle face 14*a* for cleaning. Thus, exuded ink in which adherents at the nozzle face 14*a* have been loosened or dissolved is removed. In step 138, the controller 12 moves the head 14 to a home position, and the maintenance mode ends.

In the above exemplary embodiment, an example is described in which the pressurization continues until the calculated spreading ratio is larger than the threshold TH2. However, other programming is possible such that a timeout duration is set and, if the threshold TH2 is not reached before this duration, processing is performed to emit an alarm or the like. Hence, the processing may exit the repetition loop if a state in which the threshold TH2 is not reached continues because of some problem.

Further, in the above exemplary embodiment, an example is described in which the image capture device 24 is fixedly disposed, a region of a size in which boundary positions of ink exuded from a single nozzle 14*b* of the plural nozzles 14*b* provided at the head 14 can be recognized is captured, and pressure control is performed. However, it is possible to provide a movement component that moves the image capture device 24, and detect boundary positions of ink exuded from plural nozzles 14*b*. Even in cases in which exuding states of ink at the nozzles 14*b* are likely to differ, such as, for example, a case in which different inks are ejected from the plural nozzles 14*b* of one head 14, a case in which there are differing nozzle diameters and the like, this may be dealt with the single image capture device 24. Thus, a reduction in costs compared to a case in which image capture devices are plurally provided in correspondence with respective target nozzles 14*b* is enabled.

As has been described hereabove, in the exemplary embodiment, boundary positions of ink on the nozzle face 14*a* are detected from captured image data obtained by the image capture device 24, a spreading radius of the ink is calculated from the boundary positions, and pressurization of the pump 18 is stopped when the spreading radius exceeds the threshold TH2. Consequently, ink exuded from neighboring nozzles 14*b* can be prevented from coming into contact and aggregating together, while spreading of ink on the head 14 can be made sufficiently great. Therefore, adherents in vicinities of the ejection apertures of the nozzles 14*b* may be immersed in the ink, dissolved or loosened from the nozzle face 14*a* and then wiped off with the wiping member 20, without dripping of the ink. In addition, damage to the nozzle face 14*a* during wiping can be avoided. Furthermore, a detector (sensor) that senses boundary positions of ink is provided in the embodiment, and pressurization is adjusted in accordance with detection results therefrom. Therefore, even if surface tension of the ink or the like changes due to aging deterioration or ambient temperature, the spreading state of the ink may be detected by the detector and pressurization may be stopped with excellent timing, unaffected by the aging deterioration or the ambient temperature.

In the exemplary embodiment, a spreading radius of the exuded ink is calculated. However, a spreading area of the exuded ink may be calculated. Alternatively, the image capture device 24 may be disposed at a position at which a predetermined region including an intermediate point between neighboring nozzles 14*b* can be captured, and control performed so as to stop the pressurization when a separation distance between boundary positions of ink exuded from the respective neighboring nozzles 14*b* reaches a predetermined distance.

If a spacing between the nozzles 14*b* is quite wide, dripping due to the weight of the exuded ink may occur before the exuded ink from a nozzle 14*b* comes into contact and aggregates with the exuded ink from a neighboring nozzle 14*b*. Therefore, in a case with such a head, the threshold TH2 may be set to a smaller value than the value described above. Thus, soiling due to dripping of ink may be prevented. A spreading radius of dripping may be determined by prior testing or the like and a preferable threshold TH2 may be set on the basis thereof.

Second Exemplary Embodiment

In the first exemplary embodiment, a case has been described in which the image capture device 24 that captures the head 14 is provided and boundary positions of ink are detected. However, the embodiment is not limited thus and boundary positions of ink may be detected with other configuration. In the second exemplary embodiment, an example is described of a case in which an electrostatic capacitance is sensed to serve as a physical quantity representing boundary positions.

Figure 4:
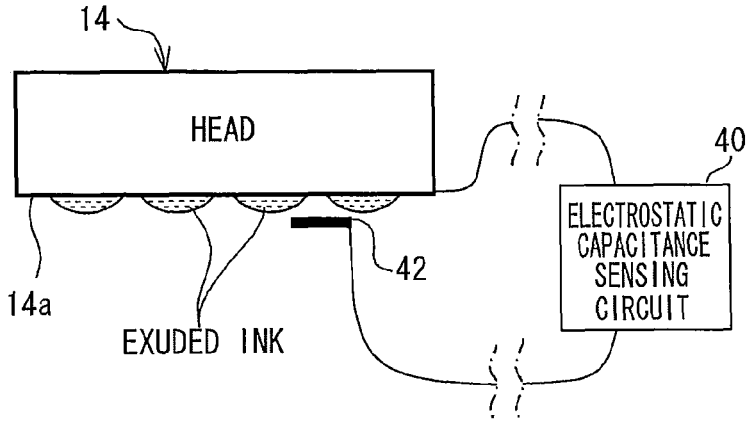
FIG. 4 relates to a second exemplary embodiment and is a view showing an example of constitution of a measurement unit that measures an electrostatic capacitance of a nozzle face.

FIG. 4 is a view showing an example of configuration of a measurement unit that measures an electrostatic capacitance of the nozzle face 14*a*. Structures of the droplet ejection device 10 other than the measurement unit (the controller 12, the sub-tank 16, the pump 18, the wiping member 20 and so forth) are the same as in the first exemplary embodiment and thus will not be illustrated or described.

As shown in FIG. 4, an electrode 42, which serves as a first electrode, is disposed to be parallel with the nozzle face 14*a* of the head 14, and an electrostatic capacitance sensing circuit 40, which senses electrostatic capacitance, is provided between the electrode 42 and the nozzle face 14*a*. The nozzle face 14*a* is formed of a plate which performs the function of a second electrode (or the second electrode is embedded in a plate). The electrostatic capacitance sensing circuit 40 is connected to the controller 12, and inputs electrostatic capacitance sensing results into the controller 12. Electrostatic capacitance varies with the presence or absence of ink between the electrode 42 and the nozzle face 14*a* (the plate). In the second exemplary embodiment, the electrostatic capacitance is utilized as a physical quantity representing the boundary positions of the ink exuded from the nozzles 14*b*.

The electrode 42 is at a position separated by a predetermined distance from the head 14, which is a position corresponding with an intermediate portion between neighboring nozzles 14*b*. When ink exuded from the nozzles 14*b* spreads to a vicinity of the intermediate portion between the neighboring nozzles 14*b*, the electrostatic capacitance between the electrode 42 and the nozzle face 14*a* changes. Similarly to the first exemplary embodiment, the controller 12 compares the detection results inputted from the electrostatic capacitance sensing circuit 40 with a pre-specified threshold, and stops pressurization of the pump 18 at a time at which the electrostatic capacitance reaches the threshold. The threshold may be set by finding an electrostatic capacitance immediately before ink exuded from a nozzle 14*b* coming into contact with ink exuded from a neighboring nozzle 14*b*, by testing beforehand, and storing a value slightly smaller than this electrostatic capacitance in the ROM or other storage component to serve as the threshold.

An improvement in detection accuracy may be expected if the electrode 42 is disposed closer to the nozzle face 14*a* but, due to the risk of ink adhering to the electrode 42 and the electrode 42 becoming soiled, it is preferable to dispose the electrode 42 away from the nozzle face 14*a* in a range at which ink will not adhere thereto.

Because the electrode 42 is provided, electrostatic capacitance sensed and pressure controlled as described above, ink exuded from neighboring nozzles 14*b* will not touch together. Therefore, the same effects as in the first exemplary embodiment can be realized, in addition to which there is a benefit in that a component that detects ink boundary positions may be structured at low cost.

The electrode 42 may be provided as described above in each intermediate position vicinity between the nozzles 14*b* at both sides of a single nozzle 14*b*, and respective electrostatic capacitances may be sensed. Further, plural electrodes 42 may be provided so as to sense electrostatic capacitances of ink exuded from a particular plurality of the nozzles 14*b*. Thus, detection accuracy of ink boundary positions can be raised.

Third Exemplary Embodiment

In the third exemplary embodiment, an example will be described of a case in which ink boundary positions are detected by a circuit which senses a resistance value between two electrodes.

Figure 5:
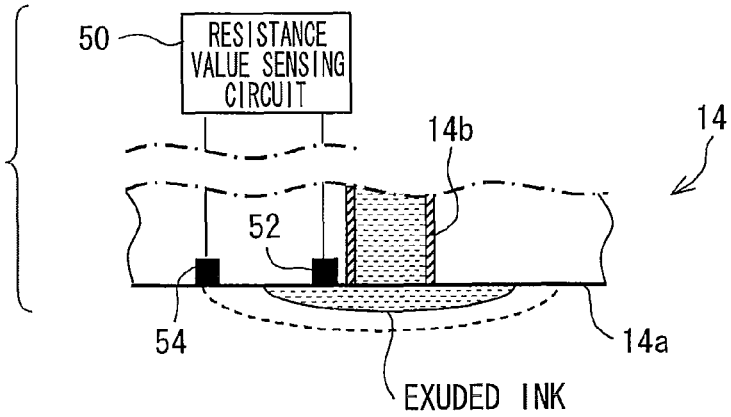
FIG. 5 relates to a third exemplary embodiment and is a view showing an example of constitution of a measurement unit at which two electrodes are provided at a nozzle face and a resistance value is measured.

FIG. 5 is a view showing an example of configuration of a measurement unit at which two electrodes are provided at the nozzle face 14*a* and a resistance value is measured. Structures of the droplet ejection device 10 other than the measurement unit (the controller 12, the sub-tank 16, the pump 18, the wiping member 20 and so forth) are the same as in the first exemplary embodiment and so will not be illustrated or described.

A first electrode 52 is disposed in the vicinity of one nozzle 14*b*, and a second electrode 54 is disposed at a position slightly closer to the first electrode 52 than an intermediate position between that nozzle 14*b* and a neighboring nozzle 14*b*. A resistance value sensing circuit 50, which senses an electrical resistance, is connected to each of the first electrode 52 and the second electrode 54. Electrical resistance varies with the presence or absence of ink (the spreading state). Accordingly, the electrical resistance is sensed by the resistance value sensing circuit 50 to serve as a physical quantity representing the boundary positions of the ink.

When the pump 18 starts to apply pressure under the control of the controller 12, ink exuded from the nozzle 14*b* first comes into contact with the first electrode 52. Then, as the pressurization continues, the exuded ink continues to spread. Hence, when the exuded ink reaches close to the intermediate point between the neighboring nozzles 14*b*, the exuded ink comes into contact with the second electrode 54. Accordingly, the resistance value between the electrodes suddenly falls. Thus, it is sensed from the resistance value that the boundary position of the ink has reached the region at which the second electrode 54 is disposed. The resistance value sensed by the resistance value sensing circuit 50 is inputted to the controller 12, and when the resistance value falls below a pre-specified threshold, pressurization by the pump 18 stops. The threshold can be set by finding an electrical resistance immediately before the ink boundary position reaching the intermediate point, by testing beforehand, and storing a value slightly larger than this electrical resistance.

Because the first electrode 52 and second electrode 54 are provided and electrical resistance is sensed and pressure controlled as described above, ink exuded from neighboring nozzles 14*b* will not touch together. Therefore, the same effects as in the first exemplary embodiment can be realized, in addition to which there is an effect in that the electrodes may be incorporated in the nozzle face 14*a* of the head 14, and costs are further reduced.

The second electrode 54 may be provided as described above at each of intermediate position vicinities between the nozzles 14*b* at both sides of the single nozzle 14*b*, and respective electrical resistances sensed. Further, the pair of electrodes (the first electrode 52 and the second electrode 54) may be provided at plural locations so as to sense boundary positions of ink exuded from a particular plurality of the nozzles 14*b*. Thus, detection accuracy of ink boundary positions is raised.

Fourth Exemplary Embodiment

In the forth exemplary embodiment, an example will be described of a case in which ink boundary positions are detected by irradiating laser light onto the nozzle face and measuring intensities of reflected light of the laser light.

Figure 6:
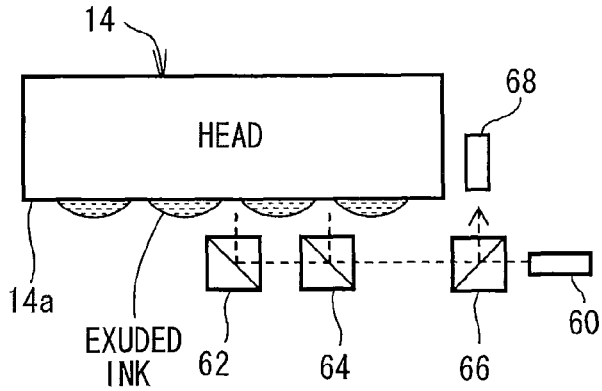
FIG. 6 relates to a fourth exemplary embodiment and is a view showing an example of constitution of a measurement unit that illuminates laser light at a nozzle face and measures reflected light.
Figure 7A:
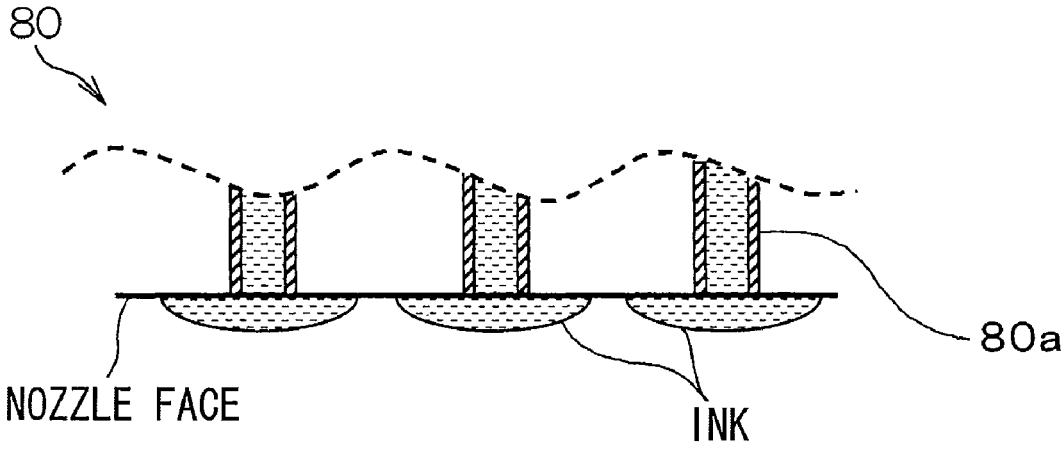
FIG. 7A PRIOR ART
FIG. 7A is a view showing a state in which ink is exuded from nozzles.
Figure 7B:
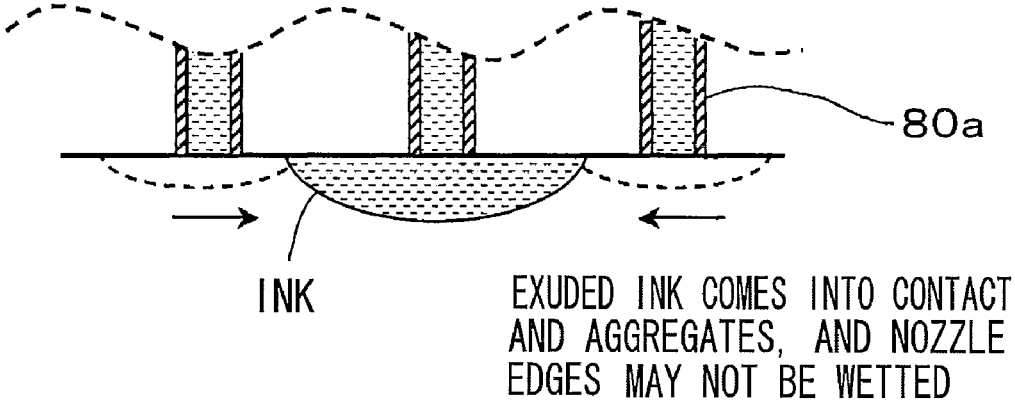
FIG. 7B PRIOR ART
FIG. 7B is a view showing a state in which ink exuded from neighboring nozzles has come into contact and aggregated.

FIG. 6 is a view showing an example of configuration of a measurement unit that emits laser light at the nozzle face 14*a* and measures reflected light of the laser light. Structures of the droplet ejection device 10 other than the measurement unit (the controller 12, the sub-tank 16, the pump 18, the wiping member 20 and so forth) are the same as in the first exemplary embodiment and so will not be illustrated or described.

A laser irradiator 60 is disposed in the vicinity of the head 14. A mirror 62 and a beam splitter 64 are respectively disposed at positions opposing the nozzle face 14*a* of the head 14, which are positions slightly closer to an object nozzle 14*b* than intermediate positions between the object nozzle 14*b* and the nozzles 14*b* that neighbor the object nozzle 14*b* at two sides thereof. Of these positions, the beam splitter 64 is disposed at the position that is closer to the laser irradiator 60. A beam splitter 66 is disposed between the laser irradiator 60 and the beam splitter 64. Laser light emitted from the laser irradiator 60 is inputted to the beam splitter 66 and reflected and transmitted. The transmitted laser light thereof is inputted to the beam splitter 64. The laser light incident on the beam splitter 64 is split into plural light beams (here, two) and reflected and transmitted. The reflected laser light thereof is irradiated to the nozzle face 14*a*, and the transmitted laser light thereof is incident on the mirror 62, is reflected and is irradiated to the nozzle face 14*a*.

Reflected light of the laser light that is irradiated at the nozzle face 14*a* from the mirror 62 is incident on the mirror 62 again and reflected, and is inputted to the beam splitter 64. The reflected light inputted to the beam splitter 64 is reflected and transmitted by the beam splitter 64, and the reflected light thereof is inputted to the beam splitter 66.

Reflected light of the laser light irradiated at the nozzle face 14*a* from the beam splitter 64 is inputted to the beam splitter 64 again and is reflected and transmitted, and transmitted light thereof is inputted to the beam splitter 66.

When reflected light is inputted to the beam splitter 66, the light is reflected and transmitted, and the reflected light thereof is incident on a sensor 68. The respective reflected lights from the mirror 62 and the beam splitter 64 are inputted to the beam splitter 66 with timings which are offset by a predetermined duration according to a difference between the optical path lengths thereof. Therefore, the reflected lights are incident on the sensor 68 with timings which are offset by the predetermined duration. The sensor 68 senses the respective reflected lights received from the beam splitter 66, and detects an intensity thereof.

When the pump 18 starts to apply pressure under the control of the controller 12, ink exuded from the nozzle 14*b* continues to spread. As boundary positions of the ink approach the intermediate positions between the neighboring nozzles 14*b*, the intensity value detected by the sensor 68 changes. The intensity value of reflected light detected by the sensor 68 is inputted to the controller 12, and when the intensity value exceeds a pre-specified threshold, pressurization by the pump 18 stops. The threshold can be set by finding an intensity value immediately before the ink boundary positions reaching the intermediate points, by testing beforehand or the like, and storing a value slightly smaller than this intensity value.

Because the laser irradiator 60 that emits the laser light and the sensor 68 that senses the reflected light are provided, intensity values of the reflected light of the laser light irradiated at the nozzle face 14*a* are detected, and pressure is controlled as described above, the pressurization may be stopped immediately before the ink exuded from neighboring nozzles 14*b* touches together. Therefore, the same effects as in the first exemplary embodiment can be realized.

In the forth exemplary embodiment, an example is described of detecting boundary positions of ink exuded from a single nozzle 14*b* at plural positions (two positions at two sides). However, just one boundary position may be detected to control the pressurization. Furthermore, in the forth exemplary embodiment, an example has been described in which laser light to be irradiated at plural different positions of the nozzle face 14*a* is emitted from the single laser irradiator 60. However, a structure is possible in which laser irradiators are plurally provided and the plural different positions are irradiated respectively therefrom.

In the first to fourth exemplary embodiments described hereabove, examples have been described in which the interior of the head 14 is pressurized in the maintenance mode by pressurizing the sub-tank 16. However, the embodiments are not to be limited thus. For example, a structure is possible in which a pump is provided for directly pressurizing the interior of the head 14, and the interior of the head 14 is directly pressurized by this pump.

As described hereabove, the control device, control method and program storage medium of a droplet ejection head according to the embodiments are capable of causing liquid to exude broadly onto a nozzle face without the liquid exuded from a nozzle coming into contact with and aggregating with the liquid exuded from a neighboring nozzle, and may improve cleaning characteristics.

Further, because a boundary of the spreading liquid is progressively detected with a sensing component and pressurization is stopped, the pressurization may be stopped with excellent timing regardless of changes due to aging deterioration of the liquid, ambient temperature or the like, the liquid may be caused to exude widely on the nozzle face without the liquid exuded from a nozzle coming into contact and aggregating with the liquid exuded from a neighboring nozzle, and cleaning characteristics can be improved.

A position of the boundary of the liquid exuded onto the nozzle face may be a position of an outer periphery of an area of contact between the exuded liquid and the nozzle face.

In the configuration described above, the controller may further perform control for at least one of stopping the pressurization or serving notice of an error using an error notification section, in a case in which, according to detection results of the detector, an amount of change of the position of the boundary is not more than a predetermined value by a predetermined time lapse after commencement of pressurization at the interior of the droplet ejection head.

In the configuration described above, the detector may include: an imaging section that captures an image of the nozzle face of the droplet ejection head; and a determination section that determines the position of the boundary from the captured image.

In the configuration described above, the detector may include: an electrode disposed at a position opposing the nozzle face; and an electrostatic capacitance detector that detects an electrostatic capacitance between the electrode and the nozzle face that serves as a physical quantity representing the position of the boundary.

In the configuration described above, the detector may include: an irradiation section that irradiates laser light toward a position between neighboring nozzles of the nozzle face that is closer to one of the neighboring nozzles relative to an intermediate position between the neighboring nozzles; and a reflected light intensity detector that senses reflected light of the irradiated laser light and detects an intensity of the sensed reflected light that serves as a physical quantity representing the position of the boundary.

In the configuration described above, the detector may include: an irradiation section that irradiates laser light toward a position between neighboring nozzles of the nozzle face that is closer to one of the neighboring nozzles relative to an intermediate position between the neighboring nozzles; and a reflected light intensity detector that senses reflected light of the irradiated laser light and detects an intensity of the sensed reflected light that serves as a physical quantity representing the position of the boundary.

In the configuration described above, the detector may detect boundary positions of the liquid exuded onto the nozzle face from at least one nozzle at a plurality of locations.

According to the aspects of the present invention as described hereabove, regardless of changes due to aging deterioration of a liquid, ambient temperature or the like, the liquid may be caused to exude widely on a nozzle face without the liquid exuded from a nozzle coming into contact and aggregating with the liquid exuded from a neighboring nozzle, and cleaning characteristics may be improved.

What is claimed is:

1. A droplet ejection head control device comprising:

a pressure alteration section that alters the pressure of an interior of a droplet ejection head, the droplet ejection head being provided with a plurality of nozzles and supplied with a liquid;

a detector that detects a position of a boundary of liquid which is exuded onto a nozzle face from at least one nozzle of the droplet ejection head in accordance with pressurization at the interior of the droplet ejection head; and a controller that, after commencement of the pressurization at the interior of the droplet ejection head, controls the pressure alteration section on the basis of detection results of the detector such that the pressurization is stopped before respective boundaries of the liquid exuded onto the nozzle face from neighboring nozzles come into contact with each other.

2. The control device according to claim 1, wherein the controller further performs control for at least one of stopping the pressurization or serving notice of an error using an error notification section, in a case in which, according to detection results of the detector, an amount of change of the position of the boundary is not more than a predetermined value by a predetermined time lapse after commencement of pressurization at the interior of the droplet ejection head.

3. The control device according to claim 1, wherein the detector comprises:

an imaging section that captures an image of the nozzle face of the droplet ejection head; and a determination section that determines the position of the boundary from the captured image.

4. The control device according to claim 1, wherein the detector comprises:

an electrode disposed at a position opposing the nozzle face; and an electrostatic capacitance detector that detects an electrostatic capacitance between the electrode and the nozzle face that serves as a physical quantity representing the position of the boundary.

5. The control device according to claim 1, wherein the detector comprises:

a pair of electrodes disposed apart from one another, and disposed between neighboring nozzles of the nozzle face further toward a side of one of the neighboring nozzles relative to an intermediate position between the neighboring nozzles; and an electrical resistance detector that detects an electrical resistance between the pair of electrodes that serves as a physical quantity representing the position of the boundary.

6. The control device according to claim 1, wherein the detector comprises:

an irradiation section that irradiates laser light toward a position between neighboring nozzles of the nozzle face that is closer to one of the neighboring nozzles relative to an intermediate position between the neighboring nozzles; and a reflected light intensity detector that senses reflected light of the irradiated laser light and detects an intensity of the sensed reflected light that serves as a physical quantity representing the position of the boundary.

7. The control device according to claim 1, wherein the detector detects boundary positions of the liquid exuded onto the nozzle face from at least one nozzle at a plurality of locations.

8. A method of controlling a droplet ejection head, the method comprising:

pressurizing an interior of the droplet ejection head using a pressure alteration section, the droplet ejection head being provided with a plurality of nozzles and supplied with a liquid;

after commencement of the pressurization at the interior of the droplet ejection head, detecting a position of a boundary of liquid which is exuded onto a nozzle face from at least one nozzle of the droplet ejection head in accordance with the pressurization; and controlling the pressure alteration section on the basis of detection results such that the pressurization is stopped before respective boundaries of the liquid exuded onto the nozzle face from neighboring nozzles come into contact with each other.

9. The control method according to claim 8, wherein the controlling comprises performing at least one of stopping the pressurization or serving notice of an error using an error notification section, in a case in which, according to the detection results, an amount of change of the position of the boundary is not more than a predetermined value by a predetermined time lapse after commencement of pressurization at the interior of the droplet ejection head.

10. The control method according to claim 8, wherein the detecting comprises:

capturing an image of the nozzle face of the droplet ejection head; and determining the position of the boundary from the captured image.

11. The control method according to claim 8, wherein the detecting comprises:

disposing an electrode at a position opposing the nozzle face; and detecting an electrostatic capacitance between the electrode and the nozzle face that serves as a physical quantity representing the position of the boundary.

12. The control method according to claim 8, wherein the detecting comprises:

disposing a pair of electrodes apart from one another and between neighboring nozzles of the nozzle face further toward a side of one of the neighboring nozzles relative to an intermediate position between the neighboring nozzles; and detecting an electrical resistance between the pair of electrodes that serves as a physical quantity representing the position of the boundary.

13. The control method according to claim 8, wherein the detecting comprises:

irradiating laser light toward a position between neighboring nozzles of the nozzle face that is closer to one of the neighboring nozzles relative to an intermediate position between the neighboring nozzles; and sensing reflected light of the illuminated laser light and detecting an intensity of the sensed reflected light that serves as a physical quantity representing the position of the boundary.

14. The control method according to claim 8, wherein the detecting comprises detecting boundary positions of the liquid exuded onto the nozzle face from at least one nozzle at a plurality of locations.

15. A computer readable storage medium storing a program causing a computer to execute a process for controlling a droplet ejection head, the process comprising:

pressurizing an interior of the droplet ejection head using a pressure alteration section, the droplet ejection head being provided with a plurality of nozzles and supplied with a liquid;

after commencement of the pressurization at the interior of the droplet ejection head, detecting a position of a boundary of liquid which is exuded onto a nozzle face from at least one nozzle of the droplet ejection head in accordance with the pressurization; and controlling the pressure alteration section on the basis of detection results such that the pressurization is stopped before respective boundaries of the liquid exuded onto the nozzle face from neighboring nozzles come into contact with each other.

* * * * *